US007013855B2

(12) United States Patent
Maeno et al.

(10) Patent No.: US 7,013,855 B2
(45) Date of Patent: Mar. 21, 2006

(54) LASH ADJUSTER FOR VALVE ACTUATOR

(75) Inventors: Eiji Maeno, Osaka (JP); Ken Yamamoto, Osaka (JP)

(73) Assignee: NTN Corporation, Shizuoka (JP)

( * ) Notice: Subject to any disclaimer, the term of this patent is extended or adjusted under 35 U.S.C. 154(b) by 0 days.

(21) Appl. No.: 10/969,851

(22) Filed: Oct. 22, 2004

(65) Prior Publication Data

US 2005/0087163 A1 Apr. 28, 2005

(30) Foreign Application Priority Data

Oct. 22, 2003 (JP) ..... 2003-362295

(51) Int. Cl.
*F01L 1/34* (2006.01)

(52) U.S. Cl. ..... 123/90.16; 123/90.54; 123/90.52; 123/90.43

(58) Field of Classification Search ..... 123/90.43, 123/90.54, 90.45, 90.52, 90.16
See application file for complete search history.

(56) References Cited

U.S. PATENT DOCUMENTS 4,981,117 A 1/1991 McRobert et al.
6,109,228 A * 8/2000 Yamamoto et al. ..... 123/90.54

FOREIGN PATENT DOCUMENTS

| | | |
|---|---|---|
| JP | 3-501758 | 4/1991 |
| JP | 11-324617 | 11/1999 |
| JP | 11-324618 | 11/1999 |
| JP | 2003-013710 | 1/2003 |
| JP | 2003-193811 | 7/2003 |
| WO | 89/05898 | 6/1989 |

* cited by examiner

*Primary Examiner*—Thomas Denion
*Assistant Examiner*—Zelalem Eshete
(74) *Attorney, Agent, or Firm*—Wenderoth, Lind & Ponack, L.L.P.

(57) ABSTRACT

A lash adjuster in a valve actuator includes a lifter body having an end plate having its top surface in contact with a cam and formed with a threaded hole in its bottom surface. An adjuster screw is inserted in the threaded hole with its external thread in engagement with the internal thread of the threaded hole. An elastic member is mounted in the threaded hole over the adjuster screw to bias the adjuster screw axially downward. Both of the threads have a sawtooth-shaped section with its pressure flank having a greater flank angle than its clearance flank. One of the pressure flanks is formed with a satin-finished rugged surface which is covered by a hard film which is non-reactive with a low-friction oil. With this arrangement, even after the threads have become worn, the friction coefficient between the thread surfaces is kept substantially constant.

28 Claims, 4 Drawing Sheets

LASH ADJUSTER FOR VALVE ACTUATOR

BACKGROUND OF THE INVENTION

This invention relates to a lash adjuster for automatically adjusting a valve clearance present in a valve actuator mounted to an internal combustion engine.

A valve actuator includes cams which rotate about a camshaft to open and close intake and exhaust valves (hereinafter simply referred to as valves). A lash adjuster is mounted between a cam and a valve to automatically adjust a valve clearance.

Such lash adjusters are disclosed in unexamined JP patent publications 11-324617 and 11-324618. Either of the lash adjusters disclosed in these publications comprises a lifter body including an end plate having a top surface in contact with a cam and a bottom surface formed with a threaded blind hole, and an adjuster screw having its external thread in threaded engagement with the internal thread of the threaded hole. An elastic member is received in the threaded hole between its top wall and the adjuster screw to axially bias the adjuster screw. Each of the internal thread of the threaded hole and the external thread of the adjuster screw has a pressure flank adapted to be pressed against the pressure flank of the other of the internal thread and the external thread while the adjuster screw is being biased upwardly by the valve stem, thereby bearing a load applied to the adjuster screw, and a clearance flank facing opposite to the pressure flank and having a flank angle smaller than the pressure flank. As a whole, both the internal thread of the threaded hole and the external thread of the adjuster screw have a sawtooth-like axial section.

This lash adjuster is mounted between a cam and the stem of a valve. A valve spring mounted around the valve stem biases the valve stem toward the cam, thereby pressing its top end against the bottom end of the adjuster screw, and pressing the end plate of the lifter body against the cam. When the cam rotates, the lash adjuster, the valve stem and the valve are all pushed down against the force of the valve spring, thus opening the valve port and then pushed up by the valve spring until the valve port is closed by the valve.

With the lash adjuster mounted on an internal combustion engine, the distance between the top end of the valve stem and the camshaft while the valve is closed may increase due e.g. to thermal expansion of the cylinder head. If this happens, the adjuster screw will quickly move axially downwardly while turning with the clearance flank of its external thread sliding on the clearance flank of the internal thread of the threaded hole, thereby absorbing any gap (valve clearance) between the top end of the valve stem and the bottom end of the adjuster screw.

While the adjustor screw is being biased upwardly by the valve stem, the pressure flank of the external thread of the adjuster screw is pressed against the pressure flank of the internal thread of the threaded hole. In this state, since the pressure flanks have a larger flank angle than the clearance flanks, the adjuster screw cannot turn and thus cannot move axially relative to the lifter body.

The distance between the top end of the valve stem and the camshaft when the valve is closed may decrease when e.g. the valve seat becomes worn. If this happens, due to fluctuating loads applied to the adjuster screw from the valve stem, the adjuster screw will be gradually pushed into the threaded hole until the valve is completely seated on the valve seat when the cam is in contact with the end plate of the lifter body at its base-circle portion. This will prevent leakage of pressure even if the valve seat becomes worn. The adjuster screw is pushed into the threaded hole until the fluctuating loads disappear and then any gap present between the pressure flanks disappears.

In normal operating conditions, however, the adjuster screw scarcely turns relative to the lifter body. It only moves axially relative to the lifter body within the range determined by any axial gap between the internal thread of the threaded hole and the external thread of the adjuster screw.

To be more specific, the adjuster screw moves axially relative to the lifter body such that the pressure flanks of the internal and external threads repeatedly collide against and separate from each other.

In order for such a lash adjuster to operate stably and reliably, it is important to maintain the friction coefficients between the pressure flanks and between the clearance flanks within suitable ranges.

Specifically, the friction coefficient between the pressure flanks has to be high enough such that the pressure flanks cannot practically slide or slip relative to each other under normal operating conditions. If the friction coefficient between the pressure flanks is low to such an extent that the pressure flanks can slide relative to each other under normal operating conditions, every time the lifter body is pushed down by the cam, the adjuster screw will be pushed into the threaded hole while rotating with the pressure flanks sliding relative to each other. Since the adjuster screw is pushed into the threaded hole, the valve lift tends to be insufficient.

If the friction coefficient between the clearance flanks is higher than a certain level, the adjuster screw will be unable to rotate in such a direction as to protrude from the threaded hole even if the valve clearance increases due e.g. to thermal expansion of the cylinder head. If the valve clearance is left unabsorbed, the adjuster screw will collide hard against the valve stem, producing much noise.

The friction coefficients between the flanks of the threads change when and if:

(1) the viscosity of oil increases as the ambient temperature drops, (2) the surface roughness of the flanks of the threads lowers due to long-term wear, and/or (3) a low-friction oil containing such additives as molybdenum (Mo) is used.

In unexamined JP patent publication 3-501758 and U.S. Pat. No. 4,981,117, in order to prevent any change in the friction coefficient between the pressure flanks due to increased viscosity of oil at a low temperature, grooves are formed in the pressure flanks to divide the respective pressure flanks into a plurality of separate sections, thereby effectively expelling any oil present between the pressure flanks when the pressure flanks move close to each other.

In order to prevent any change in the friction coefficient due to lowered surface roughness as a result of long-term wear, unexamined JP patent publication 2003-193811 proposes to increase the surface roughness to a level greater than the expected depth of wear of the flank surfaces.

On the other hand, one effective way to prevent any change in the friction coefficient due to the use of a low-friction oil is to modify the substance forming the thread surfaces to a substance which is inert with respect to the low-friction oil, thereby suppressing reaction of the thread surfaces with the additives in the oil.

Typical substances that are inert with respect to a low-friction oil include hard films of ceramics and diamond-like carbon. Ordinarily, before forming such a film on one of the thread surfaces, the thread surface is finished to a low surface roughness so as to increase the bond strength between the film and the thread surface.

Such a hard film is formed on one of the thread surfaces to reduce wear of the mating thread surfaces and to reduce the friction coefficient therebetween.

Among the parts of a valve actuator, the cams and the slidable lifters or adjusting shims tend to become worn most severely by coming into sliding contact with each other. In unexamined JP patent publication 2003-13710, in order to reduce wear of these parts, oil-keeping dimples are formed in the outer peripheries of the cams, the surface of the lifter or adjusting shim that is brought into sliding contact with each cam is finished with a small surface roughness, and a hard film as mentioned above is provided on the thus finished surface.

Also, in many of conventional lash adjusters, one of the external thread formed on the adjuster screw and the internal thread of the threaded hole in which is received the adjuster screw has its surface formed with a rugged surface, the other of the threads has its surface finished with a small surface roughness, and a hard film is provided on the surface finished with a small surface roughness.

In this type of lash adjuster, i.e. the type that includes an adjuster screw, under normal operating conditions, the external thread and the internal thread scarcely slide relative to each other. They only repeatedly collide against and separate from each other. In this regard, a conventional hard film as described above serves no practical purpose.

Also, while it is required that at least the friction coefficient between the pressure flanks be sufficiently high, the last-mentioned conventional arrangement cannot fulfill this object, either. Specifically, when the internal and external threads become worn to a certain extent, the protrusions of the rugged surface will be polished by the hard film, while the hard film will be polished by the rugged surface. This results in a sharp reduction in the surface roughness of either of the pressure flanks, which in turn causes a sharp drop in the friction coefficient between the pressure flanks.

As described above, if the friction coefficient between the pressure flanks is insufficient, every time the lash adjuster is pushed down by the cam, the adjuster screw will be pushed into the threaded hole while turning with the pressure flanks of the internal and external threads sliding relative to each other. The valve lift decreases as a result.

Since the internal and external threads repeatedly collide against each other under normal operating conditions, a crack may develop in the hard film. A crack that has formed in the film, even a small one, tends to grow rapidly in a short period of time.

An object of the invention is to provide a lash adjuster of the above-described type which can keep the friction coefficients between the pressure flanks and between the clearance flanks in predetermined ranges.

SUMMARY OF THE INVENTION

According to the invention, there is provided a lash adjuster adapted to be mounted in a valve actuator, comprising a lifter body including an end plate having in its bottom surface a threaded hole having a closed top and formed with an internal thread on its inner wall, an adjuster screw having an external thread on its outer periphery and inserted in the threaded hole with the external thread engaging the internal thread, and an elastic member mounted in the threaded hole between the closed top and the adjuster screw and biasing the adjuster screw axially downwardly, the internal thread having a first pressure flank and a first clearance flank, the external thread having a second pressure flank and a second clearance flank, the first and second pressure flanks being arranged to be pressed against each other while the adjuster screw is being biased axially upwardly, the first and second pressure flanks having a greater flank angle than the first and second clearance flanks, respectively, one of the first and second pressure flanks being formed with a satin finished rugged surface covered with a hard film having a substantially uniform thickness and non-reactive with a low-friction oil.

In order to reduce the wear of the hard film and to keep a substantially constant friction coefficient between the pressure flanks even after the pressure flanks have become worn, the hard film has preferably a hardness of no less than 1000 Hv.

In order that oil between the threads can be effectively expelled even after the threads have become worn, the hard film preferably has a roughness average RA of 1.6–12.5 micrometers.

For the same purposes as mentioned above, circles each having an area equal to the sectional area of one of dimples forming the satin-finished rugged surface preferably have diameters in the range of 50 to 500 micrometers, and the dimples have depths in the range of 10 to 50 micrometers.

In order to ensure a minimum necessary friction coefficient between the pressure flanks even after the pressure flanks become worn, the rugged surface preferably has such a profile that when the rugged surface wears to the depth of 5 micrometers, the rate of the total length of portions that are in contact with the other of the first and second pressure flanks per unit length is 10 to 80%.

This measurement method is described in JIS.B0601.

The hard film is preferably a film selected from the group consisting of a titanium nitride (TiN) film, a chromium nitride (CrN) film and a diamond-like carbon (DLC) film, and provided on the rugged surface by ion plating.

Before heat treatment, the rugged surface is preferably formed by shot peening in which round cut wire pieces made of stainless steel and having diameters in the range of 0.3 to 1.2 mm or ceramic balls having diameters in the range of 0.3 to 1.2 are hit against the one of the first and second pressure flanks.

After heat treatment, the rugged surface is preferably formed by shot peening in which silicon carbide (SiC) particles of #30–80 (595–210 micrometers) are hit against the one of the first and second pressure flanks, and then by polishing the one of the first and second pressure flanks with a barrel.

With this arrangement, the friction coefficient between the pressure flanks is kept constant even after the threads become worn. The lash adjuster can thus maintain high performance.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENTS

Figure 1:
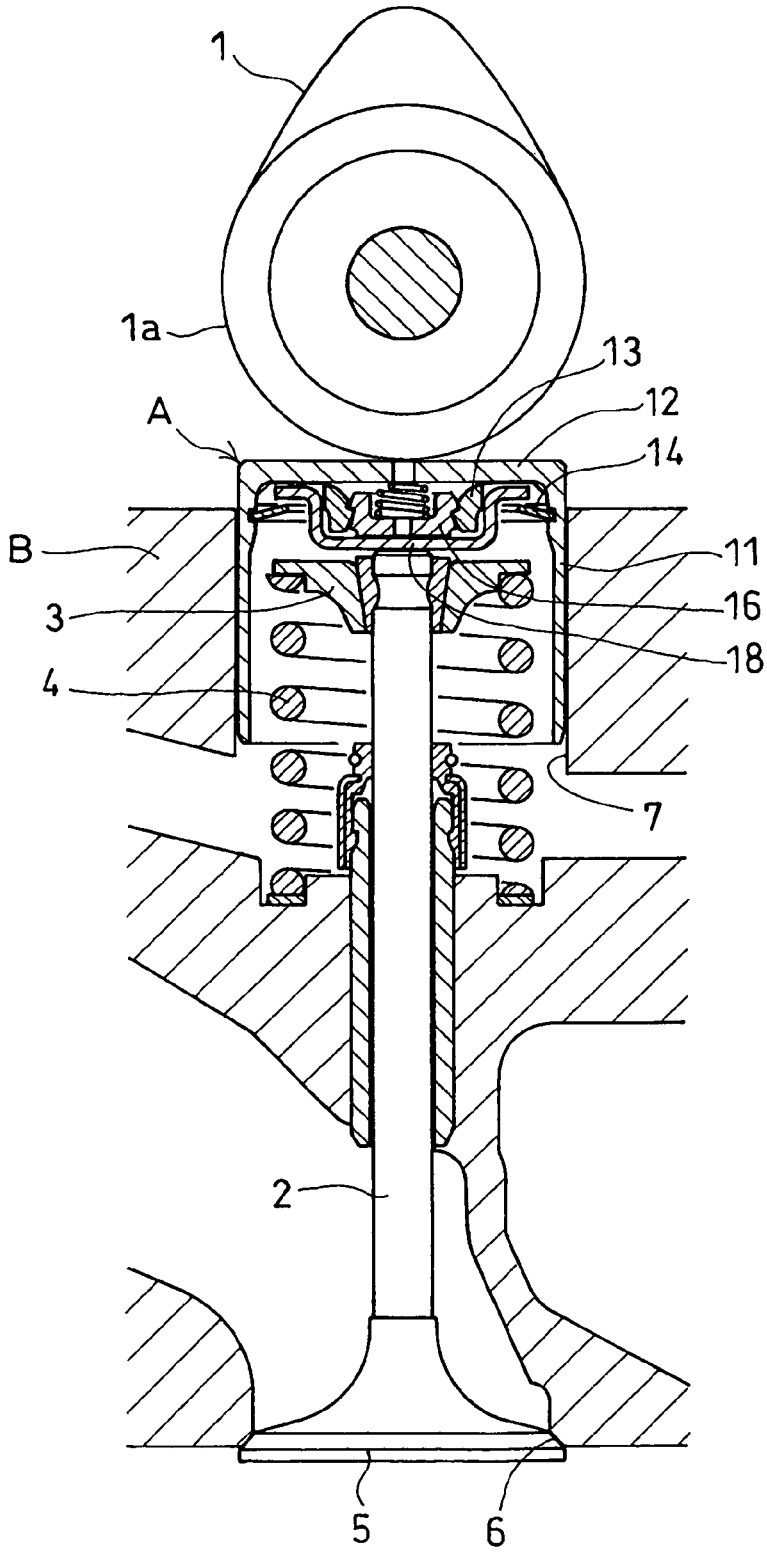
FIG. 1 is a front view in vertical section of a valve actuator in which is mounted a lash adjuster according to the present invention.

Now referring to the drawings, the lash adjuster A embodying the present invention is mounted between a cam 1 of a valve actuator and a valve stem 2. As shown, the lash adjuster A is directly pushed by the cam 1.

The valve stem 2 carries a spring retainer 3. A valve spring 4 biases the valve retainer 3 and thus the valve stem 2 axially upwardly to keep a valve (more specifically, a valve head 5 at the bottom end of the stem 2) seated on a valve seat 6.

Figure 2:
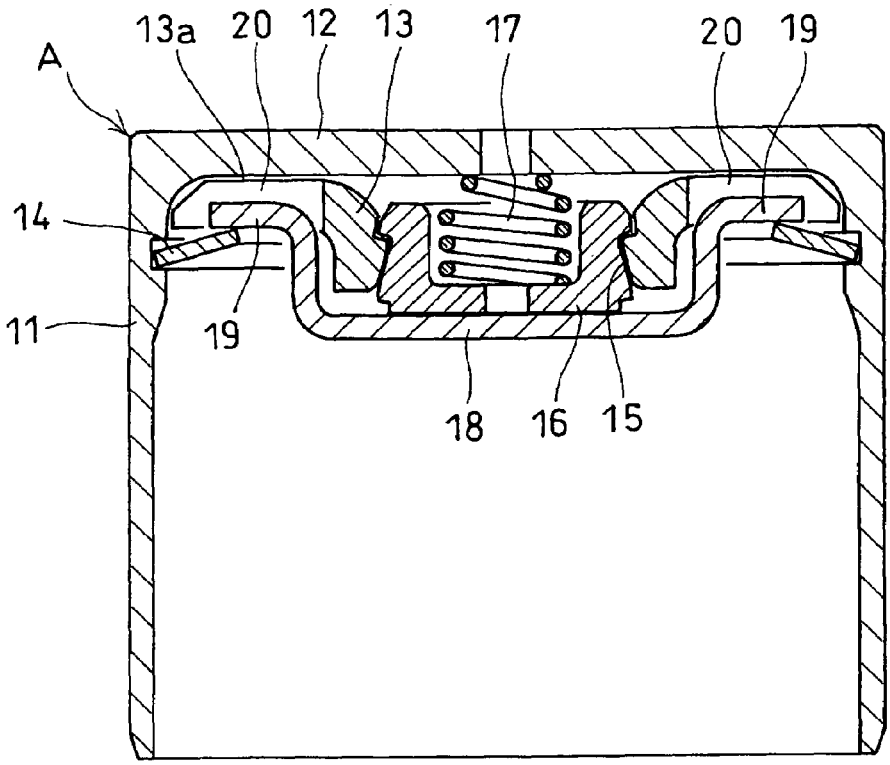
FIG. 2 is a sectional view of the lash adjuster of FIG. 1.

As shown in FIG. 2, the lash adjuster A includes a lifter body 11. As shown in FIG. 1, the lifter body 11 is slidably mounted in a guide hole 7 formed in a cylinder head B. At its top, the lifter body 11 includes an end plate 12 kept in contact with the cam 1. A nut member 13 is provided under the bottom surface of the end plate 12. The nut member 13 includes a flange 13*a* extending radially outwardly from the outer periphery thereof at its top end and pressed against the bottom surface of the end plate 12 by a snap ring 14 fitted in the inner wall of the lifter body 11.

An adjuster screw 16 is threaded into a threaded hole 15 formed in the nut member 13. An elastic member 17 is mounted between the bottom surface of the end plate 12 and the adjuster screw 16 to bias the adjuster screw 16 axially downwardly, thereby pressing the adjuster screw 16 against a bottom plate of a cup-shaped spacer 18.

The spacer 18 has a plurality of protrusions 19 extending radially outwardly from its top edge so as to be slidably received in cutouts 20 formed in the flange 13*a* of the nut member 13 while being supported by the snap ring 14 so as not to fall out of the cutouts 20.

The protrusions 19 are circumferentially immovable but vertically movable in the respective cutouts 20. Thus, the spacer 18 is non-rotatable but axially movable relative to the nut member 13.

Figure 3:
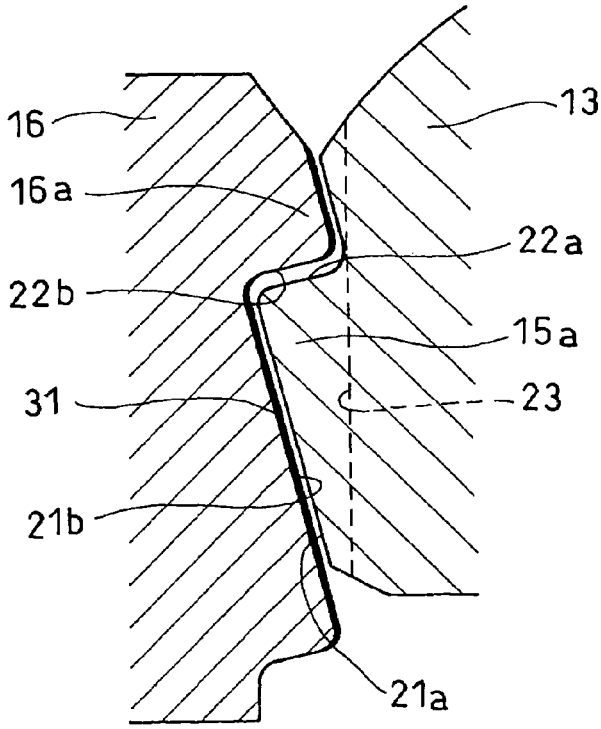
FIG. 3 is a partial enlarged section of the lash adjuster of FIG. 2, showing an internal thread of a nut member and an external thread of an adjuster screw that is in threaded engagement with the internal thread.
Figure 4:
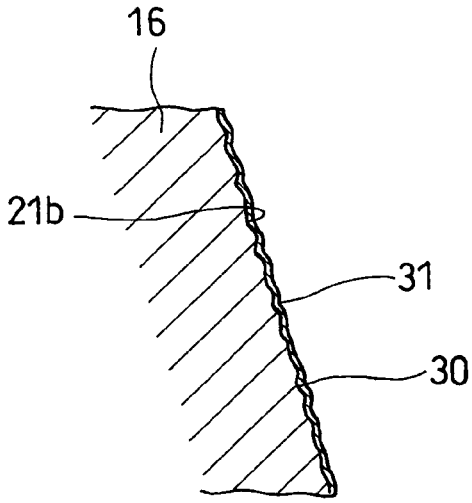
FIG. 4 is an enlarged sectional view of a portion of the external thread of FIG. 3.
Figure 5:
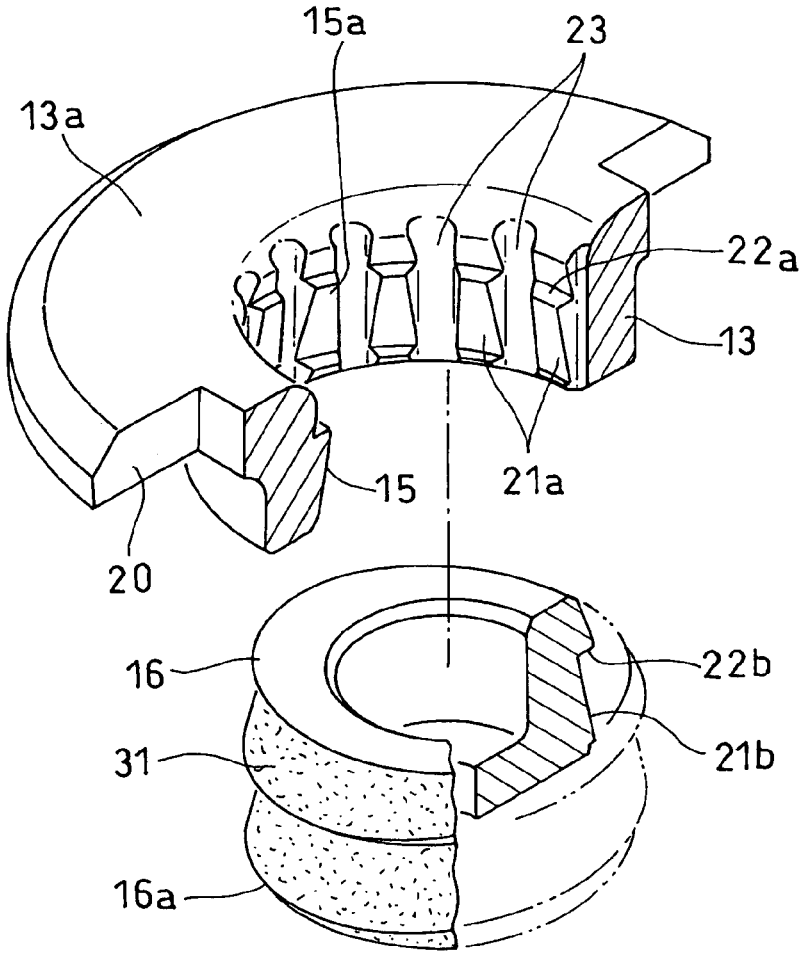
FIG. 5 is an exploded, partially cutaway, perspective view of the nut member and the adjuster screw.

As shown in FIGS. 3 and 5, an internal thread 15*a* formed on the threaded hole 15 and an external thread 16*a* formed on the outer periphery of the adjuster screw 16 have, respectively, pressure flanks 21*a* and 21*b* adapted to be pressed against each other while the adjuster screw 16 is being biased by the valve spring 4, and clearance flanks 22*a* and 22*b*. The pressure flanks 21*a* and 21*b* have a greater flank angle than the clearance flanks 22*a* and 22*b*. Thus, both threads 15*a* and 16*a* have a sawtooth-like section. Also, the threads 15*a* and 16*a* have such a lead angle that the adjuster screw 16 can turn with its clearance flank 22*b* in sliding contact with the clearance flank 22*a* in such a direction as to protrude from the threaded hole while it is not being biased by the valve spring 4.

In the inner wall of the threaded hole 15 of the nut member 13, a plurality of axial grooves 23 are preferably formed so as to divide the internal thread 15*a* into a plurality of circumferentially separated portions. The axial grooves 23 serve to more efficiently and effectively .expel oil present between the pressure flanks and between the clearance flanks.

With the lash adjuster A mounted in the valve actuator as shown in FIG. 1, the distance between the top end of the valve stem and the camshaft while the valve is closed may increase due e.g. to thermal expansion of the cylinder head B. If this happens, the adjuster screw 16 will quickly move axially downwardly while turning with the clearance flank 22*b* of its external thread 16*a* sliding on the clearance flank 22*a* of the internal thread 15*a*, thereby absorbing any gap (valve clearance) between the valve stem 2 and the adjuster screw 16.

While the adjustor screw 16 is being biased upwardly by the valve stem 2, the pressure flank 21*b* of the external thread 16*a* of the adjuster screw 16 is pressed against the pressure flank 21*a* of the internal thread 15*a* of the threaded hole 15. In this state, since the pressure flanks 21*a* and 21*b* have a larger flank angle than the clearance flanks 22*a* and 22*b*, the adjuster screw 16 cannot turn and thus cannot move axially relative to the nut member 13.

The distance between the top end of the valve stem 2 and the center of the cam 1 when the valve is closed may decrease when e.g. the valve seat 6 becomes worn. If this happens, due to fluctuating loads applied to the adjuster screw 16 from the valve stem 2, the adjuster screw 16 will be gradually pushed into the threaded hole 15 while turning until the valve head 5 is completely seated on the valve seat 6 when the cam 1 is in contact with the end plate 12 of the lifter body 11 at its base-circle portion 1*a*. This will prevent leakage of pressure even if the valve seat 6 becomes worn. The adjuster screw 16 is pushed into the threaded hole 15 until the fluctuating loads disappear and then any gap present between the pressure flanks disappears, and not any further.

In normal operating conditions, however, the adjuster screw 16 scarcely turns relative to the nut member 13. It only repeatedly moves axially relative to the nut member 13 within the range determined by any axial gap between the internal thread 15*a* of the threaded hole 15 and the external thread 16*a* of the adjuster screw 16.

To be more specific, the adjuster screw 16 moves axially relative to the nut member 13 such that the pressure flank 21*b* of its external thread 16*a* repeatedly moves toward and is pressed against the pressure flank 21*a* of the internal thread 15*a* and then separates therefrom. When the pressure flank 21*b* moves toward the pressure flank 21*a*, any lubricating oil present therebetween can be smoothly expelled through the axial grooves 23 formed in the inner wall of the threaded hole 15. The pressure flanks 21*a* and 21*b* can thus be directly pressed against each other without any oil present therebetween. This prevents the adjuster screw 16 from turning and being pushed into the threaded hole 15, thereby preventing shortening of the valve lift.

In order for the adjuster screw 16 to smoothly move axially while turning to absorb any valve clearance, the friction coefficient between the clearance flank 22*a* of the internal thread 15*a* and the clearance flank 22*b* of the external thread 16*a* has to be sufficiently small. On the other hand, in order to maintain a large valve lift, it is necessary to prevent the adjuster screw 16 from being pushed into the threaded hole 15 while turning relative to the nut member 13 under normal operating conditions.

For this purpose, it is necessary to keep the friction coefficient between the pressure flanks 21*a* and 21*b* of the internal and external threads 15*a* and 16*a* at a sufficiently high level.

In this embodiment, in order to increase the friction coefficient between the pressure flanks 21*a* and 21*b*, a satin-finished rugged surface 30 is formed on the pressure flank 21*b* of the external thread 16*a* of the adjuster screw 16 and further, a hard film 31 that is non-reactive with a low-friction oil is formed on the rugged surface 30.

The hard film 31 may be a film of titanium nitride (TiN), chromium nitride (CrN), diamond-like carbon (DLC) or a ceramic material. The film 31 of the embodiment is a DLC film.

If the satin-finished rugged surface 30 is a finely rugged surface with sharp edges and points, such sharp edges and points will not only wear the pressure flank 21*a* of the internal thread 15*a*, but also lower the bond strength between the surface 30 and the DLC film 31. The protrusions and recesses forming the rugged surface 30 are therefore preferably rounded with relatively large curvatures.

Before hardening the adjuster screw 16, which is made of steel, a rugged surface 30 made up of such moderately curved protrusions and recesses can be effectively formed on the pressure flank 21*b* of the external thread 16*a* of the adjuster screw 16 by shot peening in which blasting materials having their edges rounded are hit against the adjuster screw 16. The blasting materials used may be round cut wire (RCW) pieces which are formed by cutting a stainless steel (SUS) wire into small pieces each having a length substantially equal to its diameter and rounding the edges of their cut end faces, or may be ceramic balls.

After hardening, a rugged surface 30 made up of moderately curved protrusions and recesses can be formed on the pressure flank 21*b* by shot peening using blasting materials having sharp edges and then polishing the surface formed by shot peening with a barrel to remove any pointed tips of the protrusions.

Use of blast materials made of an oxide such as silicon oxide ($SiO_2$) or aluminum oxide ($Al_2O_3$) tends to severely aggravate the bond strength between the rugged surface 30 and the DLC film 31. Therefore, blasting materials in the form of silicon carbide (SiC) chips or particles are preferably used for shot peening after hardening of the adjuster screw. Since such blasting materials are extremely hard, i.e. have a Mohs hardness of 13 and edgy, too, protrusions and recesses can be formed easily on the pressure flank 21*b* of the external thread 16*a* of the adjuster screw 16 even after hardening. But since the protrusions and recesses thus formed have sharp edges and pointed tips, they have to be removed by polishing with a barrel.

Figure 6A:
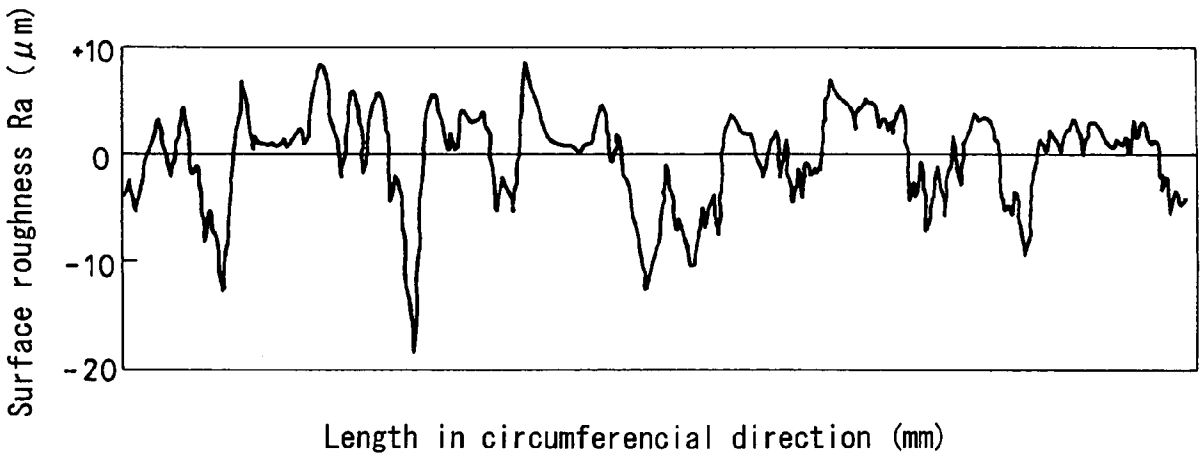
FIG. 6A is a surface roughness profile of a DLC film.
Figure 6B:
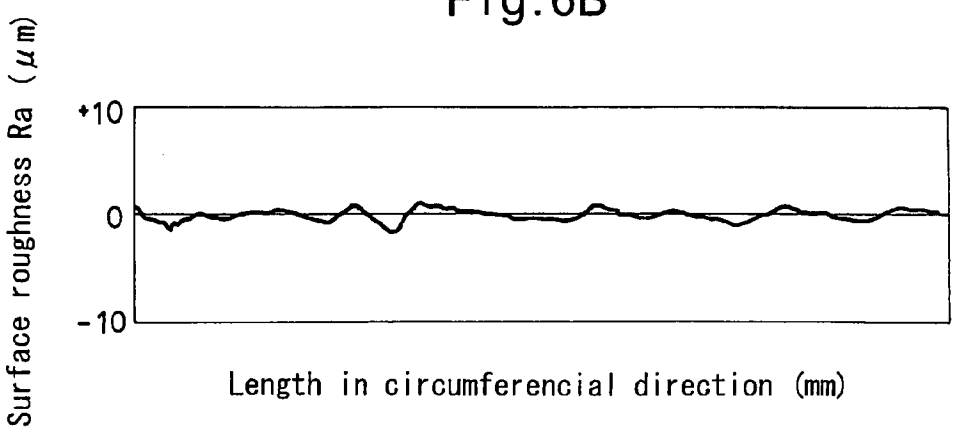
FIG. 6B is a surface roughness profile of the pressure flank of the internal thread formed on the nut member.

FIG. 6A shows a surface roughness curve of the DLC film 31 provided on the rugged surface 30 and having a roughness average Ra between 1.6 and 12.5 micrometers. FIG. 6B shows a surface roughness curve of the pressure flank 21*a* of the internal thread 15*a*, which has a roughness average Ra of 0.1 to 3.2 micrometers.

By setting the roughness average Ra of the surface of the DLC film 31 at 1.6 to 12.5 micrometers, oil film present between the pressure flanks 21*a* and the 21*b* can be effectively expelled when they move toward each other. Desirably, the ability to expel oil is maintained until the end of the life of the lash adjuster.

Experiment results reveal that the pressure flank surfaces become worn to the depth of about 5 micrometers by the end of the life of the lash adjuster. Thus, in order to keep the ability to expel oil at the end of the life of the lash adjuster, the average peak-to-bottom distance, i.e. the average distance between the peaks of the protrusions and the bottoms of the recesses (which is practically the average depth of dimples in the surface 30) is preferably not less than 10 micrometers. But this distance preferably does not exceed 50 micrometers in order to prevent detrimental deformation of the thread.

Preferably, circles each having the same cross-sectional area as one of the dimples formed in the rugged surface 30 have diameters in the range of 50 to 500 micrometers. If these values are less than 50 micrometers, oil film cannot be sufficiently expelled, and if greater than 500 micrometers, it will be difficult to uniformly form protrusions and recesses on the not-so-wide pressure flank 21*b*.

For smooth movement of the adjuster screw 16 and uniformity of end products, the abovementioned circles have preferably diameters in the range of 100 to 200 micrometers. In this regard, the present invention is clearly distinguishable over the invention disclosed in JP patent publication 2003-13710, which teaches that the above-defined circles have ideally diameters in the range of 5 to 100 micrometers.

In a surface roughness profile as shown e.g. in FIG. 6A, when the pressure flanks 21*a* and 21*b* are brought into contact with each other, the rate of the total length of portions of the pressure flank 21*b* that are in contact with the pressure flank 21*a* is preferably between 10% and 80%. If this value is less than 10%, smooth movement of the adjuster screw 16 in the threaded hole 15 will be impaired. If this rate is higher than 80%, the ability to expel oil film will be insufficient. This rate is the lowest when the pressure flank 21*b* is not worn at all and will gradually increase as the pressure flank 21*b* becomes worn. Thus, the peaks of the protrusions of the rugged surface 30 are rounded so that the above rate exceeds 10% in the initial stage of use. Also, the profile of the rugged surface 30 is determined such that the above rate will not exceed 80% even after the surface 30 has become worn to the depth of 5 micrometers.

Experiment results reveal that the above-defined satin-finished rugged surface 30 can be formed by shot peening using RCW pieces or ceramic balls having diameters in the range of 0.3 to 1.2 mm as the blasting materials with the blasting air pressure set at 0.3 to 0.8 MPa. If SiC is used as blasting materials for shot peening of an adjuster screw made of a relatively hard material such as heat-treated steel, such blasting materials have preferably a particle size of #30–80 (ISO.ANSI/595 to 210 micrometers).

Unlike protrusions formed by polishing and other machining processes, protrusions formed on the pressure flank 21*b* by shot peening are widely different in height from one another. Thus, in the initial stage of use, the DLC film is brought into contact with the pressure flank 21*a* of the internal thread 15*a* only at its portions corresponding to the highest protrusions. But as the DLC film 31 wears, the contact portions of the DLC film 31 corresponding to lower protrusions come into contact with the pressure flank 21*a* one after another, so that its contact area with the pressure flank 21*a* increases gradually until the pressure flank 21*b* becomes worn to the depth of about 5 micrometers.

Ordinarily, DLC films used as surface coatings have very small thicknesses, ranging from 1 to 3 micrometers. Also, recent high-density DLC films have a hardness of about 1000–1500 Hv. If such a film is used as the DLC film 31 of the present invention, it will inevitably wear out before the end of the life of the lash adjuster.

If the surface roughness of the rugged surface 30 is small compared to the thickness of the DLC film 31, or if the protrusions of the rugged surface 30 are formed by machining and thus are substantially equal in height, the DLC film 31 tends to wear substantially uniformly over the entire area. This means that at some point, the film 31 will completely wear out substantially simultaneously over its wide area, causing the underlying rugged surface to be exposed suddenly over its wide area. This causes a sudden and substantial change in the friction coefficient between the pressure flanks, because the friction coefficient between the pressure flanks, both exposed, i.e. between steel surfaces is only about 0.04 (because tribofilm is formed between steel surfaces) and thus is significantly lower than the friction coefficient between the DLC film 31 and the pressure flank 21*a* under lubrication with a low-friction oil, which is about 0.1.

With the arrangement of the present invention, because the DLC film 31 is formed on the satin-finished rugged surface formed by shot peening, the protrusions of the rugged surface are widely different in height from each other, and thus portions of the DLC film 31 supported on the respective protrusions are also widely different in height. Thus, the DLC film wears non-uniformly over a wide area. This prevents sudden and substantial change in the friction coefficient between the flank surfaces. Also, the protrusions of the rugged surface, which are widely different in height from each other, will serve to stop growth of any crack formed in the DLC film 31.

In the embodiment, the hard film 31 comprises a DLC film formed on the pressure flank 21*b* of the external thread 16*a* of the adjuster screw 16. But the hard film 31 may be formed on the pressure flank 21*a* of the internal thread 15*a* of the threaded hole 15.

What is claimed is:

1. A lash adjuster adapted to be mounted in a valve actuator including cams, said lash adjuster comprising a lifter body adapted to be axially slidably mounted between one of said cams and a stem of a valve, said lifter body including an end plate having in its bottom surface a threaded hole having a closed top and formed with an internal thread on its inner wall, an adjuster screw having an external thread on its outer periphery and inserted in said threaded hole of said lifter body with said external thread engaging said internal thread, and an elastic member mounted in said threaded hole between said closed top and said adjuster screw for biasing said adjuster screw axially downwardly, said internal thread of said lifter body having a first pressure flank and a first clearance flank, said external thread of said adjuster screw having a second pressure flank and a second clearance flank, said first and second pressure flanks being arranged to be pressed against each other while said adjuster screw is being biased axially upwardly, said first and second pressure flanks having a greater flank angle than said first and second clearance flanks, respectively, one of said first and second pressure flanks being formed with a satin finished rugged surface covered with a hard film which has a substantially uniform thickness and is non-reactive with a low-friction oil.

2. The lash adjuster of claim 1 wherein said hard film has a hardness of not less than 1000 Hv.

3. The lash adjuster of claim 1 wherein said hard film has a roughness average RA of 1.6 to 12.5 micrometers.

4. The lash adjuster of claim 1 wherein circles each having an area equal to the sectional area of the opening of one of dimples forming said satin-finished rugged surface each have a diameter of 50 to 500 micrometers, and wherein said dimples each have a depth of 10 to 50 micrometers.

5. The lash adjuster of claim 1 wherein said rugged surface has such a profile that when said rugged surface wears to the depth of 5 micrometers, the rate of the total length of portions that are in contact with the other of said first and second pressure flanks per unit length is 10 to 80%.

6. The lash adjuster of claim 1 wherein said hard film is selected from the group consisting of a titanium nitride (TiN) film, a chromium nitride (CrN) film, a diamond-like carbon (DLC) film, and a ceramic film, and is provided on said rugged surface by ion plating.

7. The lash adjuster of claim 1 wherein said rugged surface is formed by shot peening in which round cut wire pieces made of stainless steel and each having a diameter of 0.3 to 1.2 mm or ceramic balls each having a diameter of 0.3 to 1.2 mm are hit against said one of said first and second pressure flanks, before heat treatment.

8. The lash adjuster of claim 1 wherein said rugged surface is formed after heat treatment by shot peening in which silicon carbide (SiC) particles of #30–80 (595 to 210 micrometers) are hit against said one of said first and second pressure flanks, and then by polishing said one of said first and second pressure flanks with a barrel.

9. The lash adjuster of claim 2 wherein said hard film has a roughness average RA of 1.6 to 12.5 micrometers.

10. The lash adjuster of claim 2 wherein circles each having an area equal to the sectional area of the opening of one of dimples forming said satin-finished rugged surface each have a diameter of 50 to 500 micrometers, and wherein said dimples each have a depth of 10 to 50 micrometers.

11. The lash adjuster of claim 3 wherein circles each having an area equal to the sectional area of the opening of one of dimples forming said satin-finished rugged surface each have a diameter of 50 to 500 micrometers, and wherein said dimples each have a depth of 10 to 50 micrometers.

12. The lash adjuster of claim 2 wherein said rugged surface has such a profile that when said rugged surface wears to the depth of 5 micrometers, the rate of the total length of portions that are in contact with the other of said first and second pressure flanks per unit length is 10 to 80%.

13. The lash adjuster of claim 3 wherein said rugged surface has such a profile that when said rugged surface wears to the depth of 5 micrometers, the rate of the total length of portions that are in contact with the other of said first and second pressure flanks per unit length is 10 to 80%.

14. The lash adjuster of claim 4 wherein said rugged surface has such a profile that when said rugged surface wears to the depth of 5 micrometers, the rate of the total length of portions that are in contact with the other of said first and second pressure flanks per unit length is 10 to 80%.

15. The lash adjuster of claim 2 wherein said hard film is selected from the group consisting of a titanium nitride (TiN) film, a chromium nitride (CrN) film, a diamond-like carbon (DLC) film, and a ceramic film, and is provided on said rugged surface by ion plating.

16. The lash adjuster of claim 3 wherein said hard film is selected from the group consisting of a titanium nitride (TiN) film, a chromium nitride (CrN) film, a diamond-like carbon (DLC) film, and a ceramic film, and is provided on said rugged surface by ion plating.

17. The lash adjuster of claim 4 wherein said hard film is selected from the group consisting of a titanium nitride (TiN) film, a chromium nitride (CrN) film, a diamond-like carbon (DLC) film, and a ceramic film, and is provided on said rugged surface by ion plating.

18. The lash adjuster of claim 5 wherein said hard film is selected from the group consisting of a titanium nitride (TiN) film, a chromium nitride (CrN) film, a diamond-like carbon (DLC) film, and a ceramic film, and is provided on said rugged surface by ion plating.

19. The lash adjuster of claim 2 wherein said rugged surface is formed by shot peening in which round cut wire pieces made of stainless steel and each having a diameter of 0.3 to 1.2 mm or ceramic balls each having a diameter of 0.3 to 1.2 mm are hit against said one of said first and second pressure flanks, before heat treatment.

20. The lash adjuster of claim 3 wherein said rugged surface is formed by shot peening in which round cut wire pieces made of stainless steel and each having a diameter of 0.3 to 1.2 mm or ceramic balls each having a diameter of 0.3 to 1.2 mm are hit against said one of said first and second pressure flanks, before heat treatment.

21. The lash adjuster of claim 4 wherein said rugged surface is formed by shot peening in which round cut wire pieces made of stainless steel and each having a diameter of 0.3 to 1.2 mm or ceramic balls each having a diameter of 0.3 to 1.2 mm are hit against said one of said first and second pressure flanks, before heat treatment.

22. The lash adjuster of claim 5 wherein said rugged surface is formed by shot peening in which round cut wire pieces made of stainless steel and each having a diameter of 0.3 to 1.2 mm or ceramic balls each having a diameter of 0.3 to 1.2 mm are hit against said one of said first and second pressure flanks, before heat treatment.

23. The lash adjuster of claim 6 wherein said rugged surface is formed by shot peening in which round cut wire pieces made of stainless steel and each having a diameter of 0.3 to 1.2 mm or ceramic balls each having a diameter of 0.3 to 1.2 mm are hit against said one of said first and second pressure flanks, before heat treatment.

24. The lash adjuster of claim 2 wherein said rugged surface is formed after heat treatment by shot peening in which silicon carbide (SiC) particles of #30–80 (595 to 210 micrometers) are hit against said one of said first and second pressure flanks, and then by polishing said one of said first and second pressure flanks with a barrel.

25. The lash adjuster of claim 3 wherein said rugged surface is formed after heat treatment by shot peening in which silicon carbide (SiC) particles of #30–80 (595 to 210 micrometers) are hit against said one of said first and second pressure flanks, and then by polishing said one of said first and second pressure flanks with a barrel.

26. The lash adjuster of claim 4 wherein said rugged surface is formed after heat treatment by shot peening in which silicon carbide (SiC) particles of #30–80 (595 to 210 micrometers) are hit against said one of said first and second pressure flanks, and then by polishing said one of said first and second pressure flanks with a barrel.

27. The lash adjuster of claim 5 wherein said rugged surface is formed after heat treatment by shot peening in which silicon carbide (SiC) particles of #30–80 (595 to 210 micrometers) are hit against said one of said first and second pressure flanks, and then by polishing said one of said first and second pressure flanks with a barrel.

28. The lash adjuster of claim 6 wherein said rugged surface is formed after heat treatment by shot peening in which silicon carbide (SiC) particles of #30–80 (595 to 210 micrometers) are hit against said one of said first and second pressure flanks, and then by polishing said one of said first and second pressure flanks with a barrel.

* * * * *